US012723754B2

(12) United States Patent
Baker

(10) Patent No.: US 12,723,754 B2
(45) Date of Patent: Sep. 1, 2026

(54) GAS BURNER WITH SECONDARY AND TERTIARY AIR SUPPLIES

(71) Applicant: Nieco, LLC, Windsor, CA (US)

(72) Inventor: Matthew Baker, Windsor, CA (US)

(73) Assignee: Nieco, LLC, Windsor, CA (US)

( * ) Notice: Subject to any disclaimer, the term of this patent is extended or adjusted under 35 U.S.C. 154(b) by 370 days.

(21) Appl. No.: 18/509,933

(22) Filed: Nov. 15, 2023

(65) Prior Publication Data

US 2024/0159394 A1 May 16, 2024

Related U.S. Application Data

(60) Provisional application No. 63/383,787, filed on Nov. 15, 2022.

(51) Int. Cl.
*F23D 14/84* (2006.01)

(52) U.S. Cl.
CPC ..... *F23D 14/84* (2013.01); *F23D 2203/007* (2013.01)

(58) Field of Classification Search
CPC . A47J 37/044; A21B 1/33; A21B 1/28; F23D 14/84; F23D 2203/007
USPC ..... 99/443 C, 386; 126/19 R; 431/9
See application file for complete search history.

(56) References Cited

U.S. PATENT DOCUMENTS 3,721,178 A * 3/1973 Szabrak ..... A47J 37/044 99/391
4,951,648 A * 8/1990 Shukla ..... A21B 1/245 126/21 R
2009/0178575 A1* 7/2009 Baker ..... A21B 1/245 126/41 R

* cited by examiner

*Primary Examiner* — Vivek K Shirsat
(74) *Attorney, Agent, or Firm* — Andrew F. Young, Esq.; Nolte Lackenbach Siegel

(57) ABSTRACT

A gas burner and air supply system, including at least one elongate gas burner element connected to a fuel supply and a primary air supply. Arrays of fuel/air outlets disposed on opposing sides of the gas burner element output fuel and air for combustion and to form a cooking flame. An air plenum with a low pressure air supply is disposed above the each gas burner element and has an inverted V-shaped trough disposed immediately above the gas burner. First and second low pressure inboard air outlet arrays in the trough provide a secondary air supply to the combustion process. The plenum also includes at least one outboard array of low pressure air outlets disposed above and to an outboard side of each of gas burner to create a tertiary air supply, which creates a downward curtain of pressurized air that guides and directs heat from the flames downwardly.

13 Claims, 6 Drawing Sheets

GAS BURNER WITH SECONDARY AND TERTIARY AIR SUPPLIES

CROSS REFERENCES TO RELATED APPLICATIONS

The present application claims the benefit of the fling date of U.S. Provisional Patent Application Ser. No. 63/383,787, filed Nov. 15, 2022, which application is incorporated in its entirety by reference herein.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

SEQUENCE LISTING

Not applicable.

BACKGROUND OF THE INVENTION

Field and Background of the Invention

The present invention relates generally to gas burners used to cook food products rapidly in commercial broilers, conveyor ovens, non-conveyor ovens having a fixed oven cavity, and toaster systems, and more particularly to an improved elongate gas burner and air delivery system for use in commercial broilers that utilizes a pressurized air unit to inject pressurized air near the flames of an elongate gas burner to guide heat downwardly to areas around and onto food product and to supply air (supplementing the primary air supplied for combustion) to enhance gas combustion and shape the flame to make it more efficient.

BRIEF SUMMARY OF THE INVENTION

The present invention is an elongate gas burner and air delivery system for use in a multi-source cooking system that uses a pressurized air unit to deliver and introduce pressurized air into regions proximate an elongate gas burner: firstly, in a tertiary supply delivered through air outlets disposed in opposing linear arrays along each side of the burner element, spaced apart from the element to guide heat downwardly to areas around and onto food product; and, secondly, in a secondary air supply delivered through air outlets disposed in opposing linear arrays also along each side of the burner element to supply air to the combustion process in addition to the primary air to enhance gas combustion and shape the flame to make it more efficient in the open-ended cuboid combustion chambers of conveyor broilers. The secondary air may be tightly metered to ensure that there is just enough excess air to completely burn the fuel and, thereby, to enhance efficiency and reduce emissions. The array of air outlets for the secondary air is spaced apart from the burner at a distance proportional to the diameter of the burner and also proportional to the pressure under which the fuel is expelled; thus, it is tied to the flame locus so as to contribute optimally to oxygen input to enhance combustion.

The instant invention is an improvement on the systems disclosed in the following: U.S. Pat. No. 7,997,189, to Baker et al, which is directed to a heated compressed air broiler system; U.S. Pat. No. 8,272,320, also to Baker et al, which is directed to a broiler, conveyor oven and toaster system with pressurized air guide for heat and flames, each of which are incorporated in their entirety by reference herein.

The foregoing summary broadly sets out the more important features of the present invention so that the detailed description that follows may be better understood, and so that the present contributions to the technology may be better appreciated. There are additional features of the invention that will be described in the detailed description of the preferred embodiments of the invention which will form the subject matter of the claims appended hereto.

Accordingly, before explaining the preferred embodiment of the disclosure in detail, it is to be understood that the disclosure is not limited in its application to the details of the construction and the arrangements set forth in the following description or illustrated in the drawings. The inventive apparatus described herein is capable of other embodiments and of being practiced and carried out in various ways.

Also, it is to be understood that the terminology and phraseology employed herein are for descriptive purposes only, and not limitation. Where specific dimensional and material specifications have been included or omitted from the specification or the claims, or both, it is to be understood that the same are not to be incorporated into the appended claims.

As such, those skilled in the art will appreciate that the conception, upon which this disclosure is based may readily be used as a basis for designing other structures, methods, and systems for carrying out the several purposes of the present invention. It is important, therefore, that the claims are regarded as including such equivalent constructions as far as they do not depart from the spirit and scope of the present invention. Rather, the fundamental aspects of the invention, along with the various features and structures that characterize the invention, are pointed out with particularity in the claims annexed to and forming a part of this disclosure. For a better understanding of the present invention, its advantages and the specific objects attained by its uses, reference should be made to the accompanying drawings and descriptive matter in which there are illustrated the preferred embodiment.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1A is a cross-sectional side view in elevation of a broiler showing gas burners ignited and burning fuel but with neither secondary nor tertiary air turned on;

FIG. 1B is the same view with both secondary and tertiary air turned on;

FIG. 2A is a detailed cross-sectional side view in elevation showing the flame shape as shown in FIG. 1A, i.e., when secondary and tertiary air is not turned on;

FIG. 2B is the same view showing the flame shape as shown in FIG. 1B, with secondary and tertiary air supplies turned on;

DETAILED DESCRIPTION OF THE INVENTION

Figure 1A:
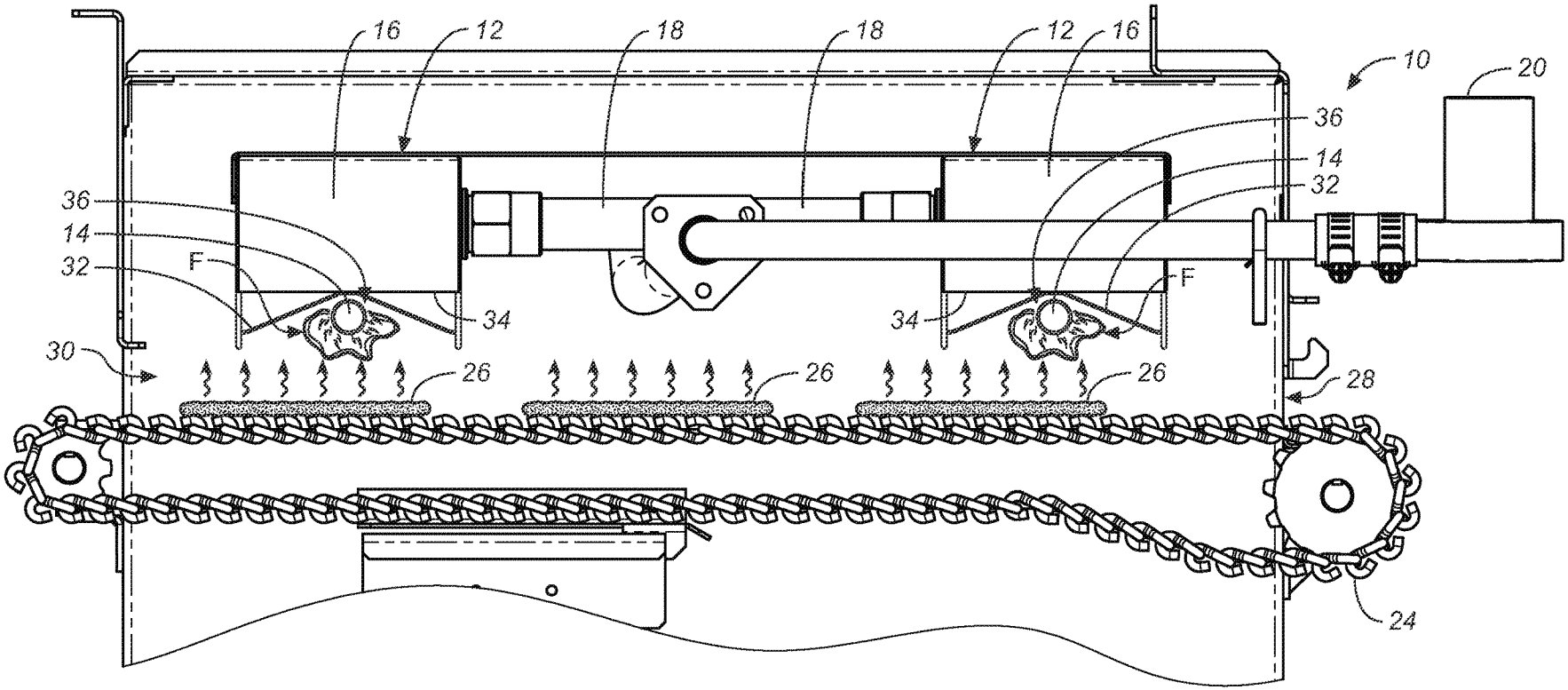
Figure 1B:
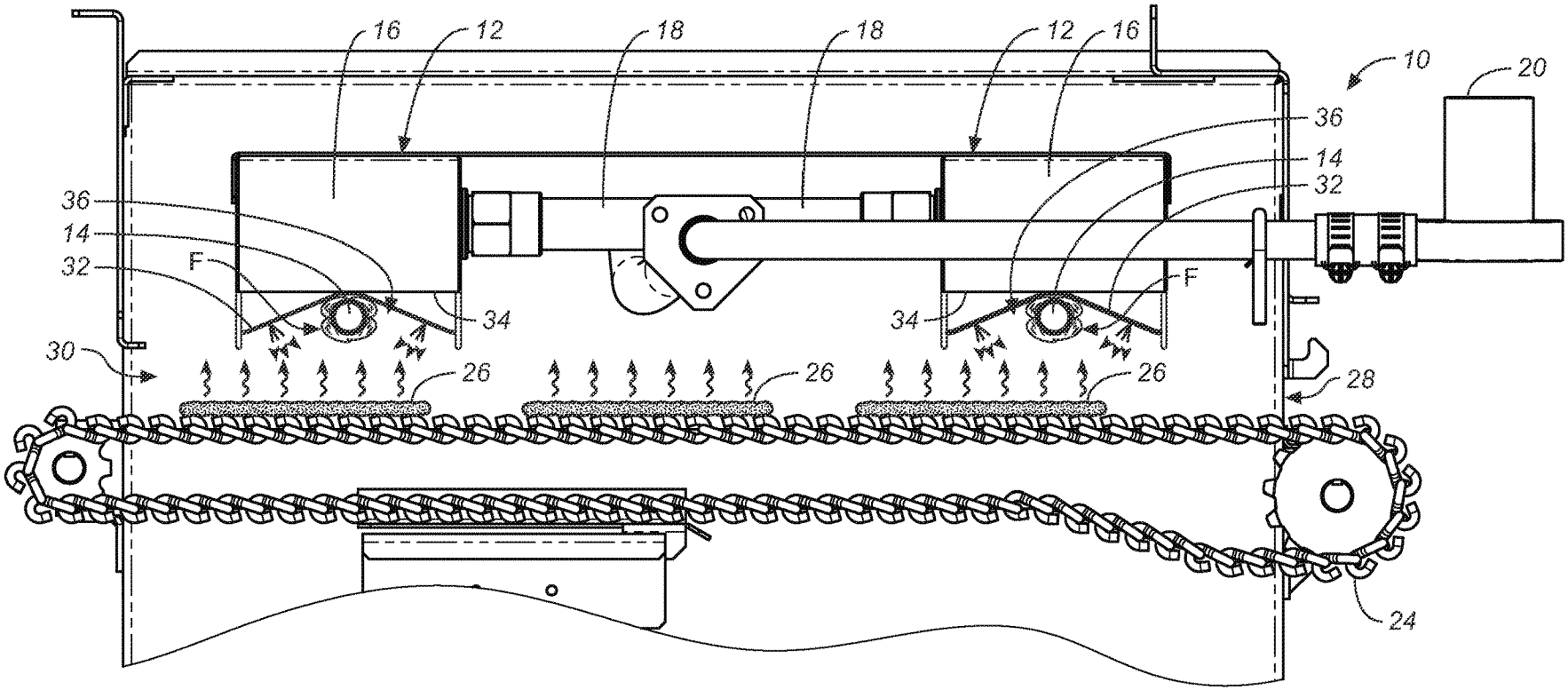
Figure 2A:
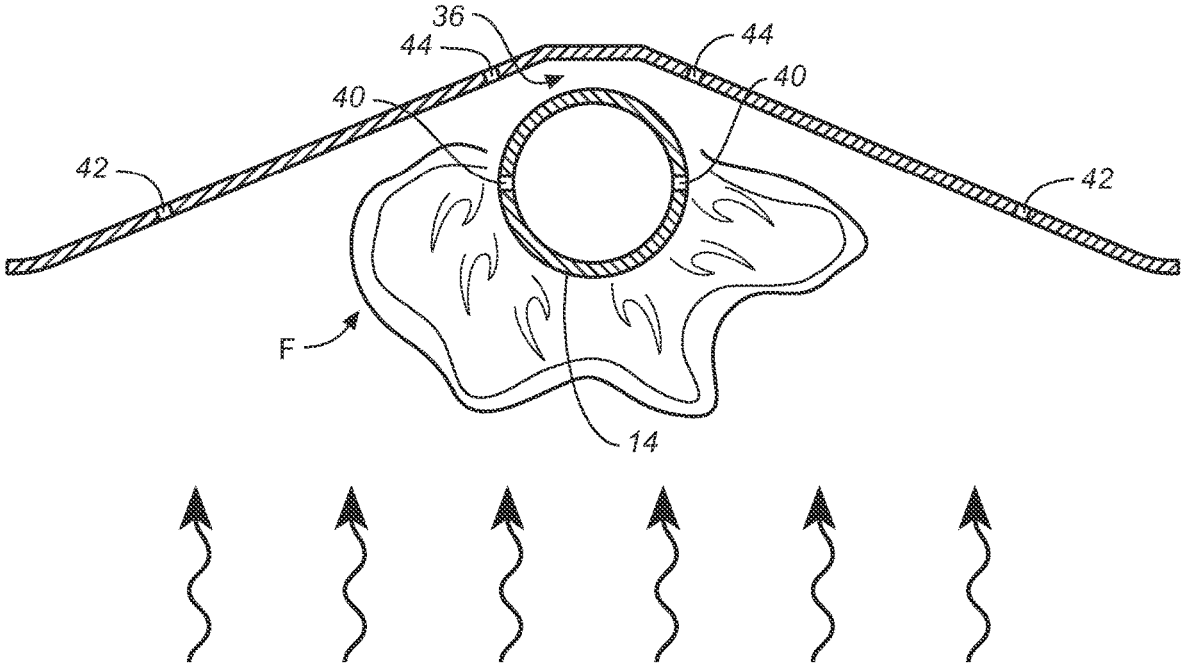
Figure 2B:
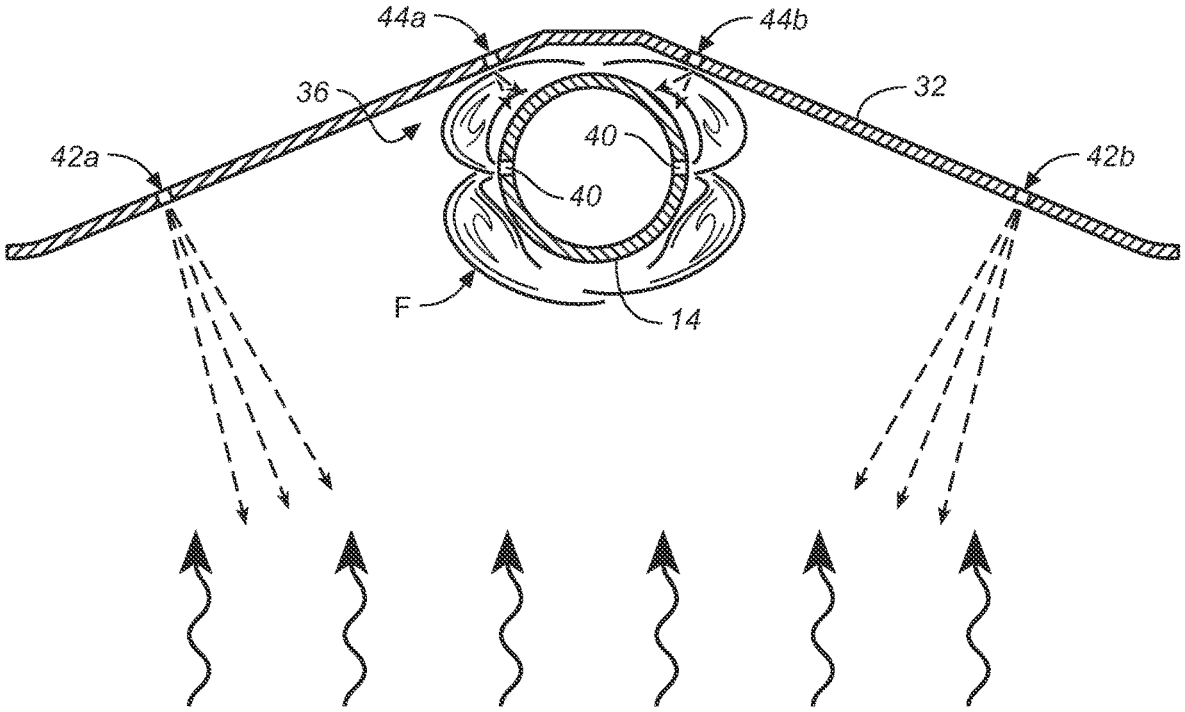
Figure 3:
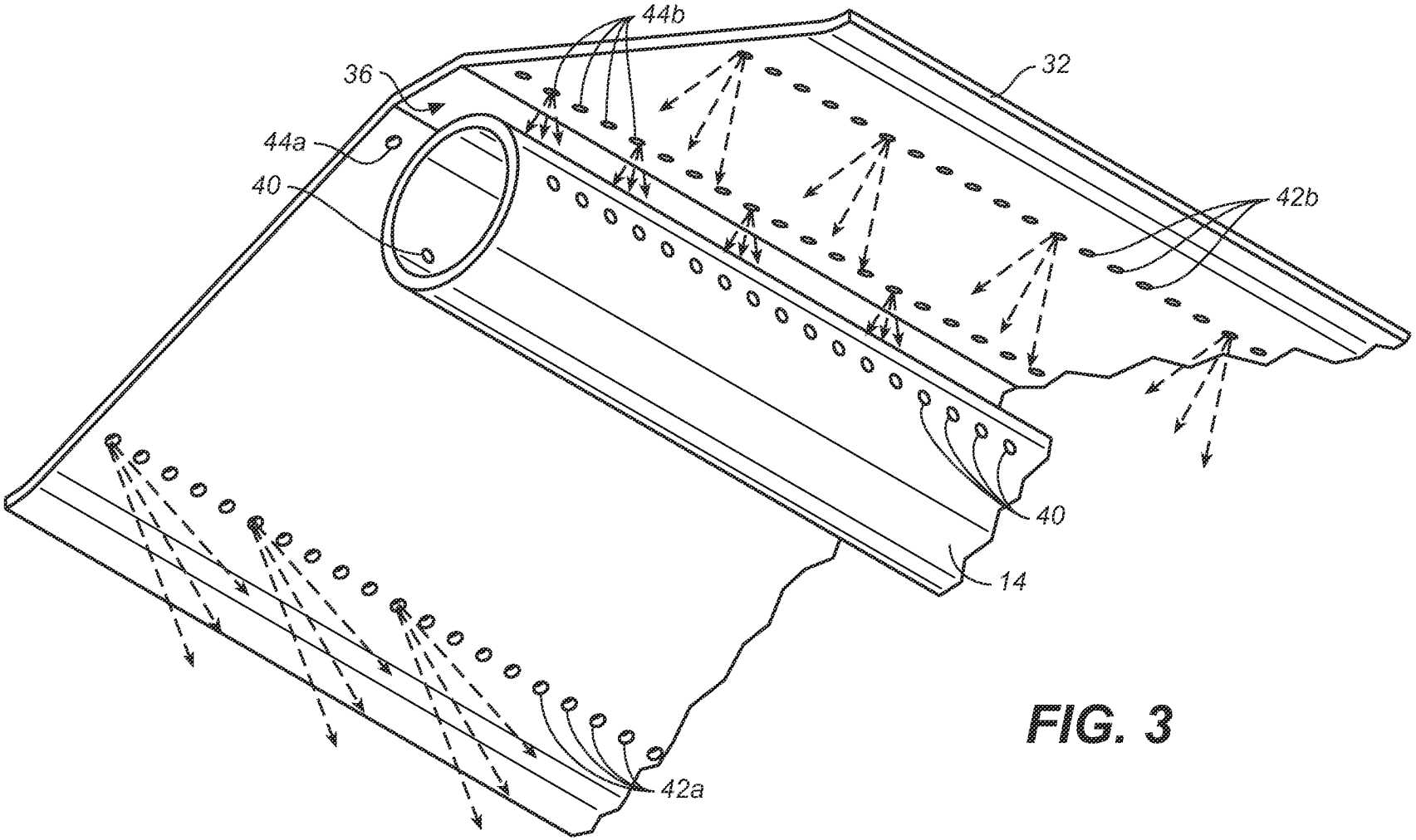
FIG. 3 is a lower perspective view showing the primary, secondary, and tertiary air outlet arrays used in the improved broiler burner of the present invention.

Referring to FIGS. 1A through 3, wherein like reference numerals refer to like components in the various views, there is shown an improved gas burner with a pressurized tertiary air heat and flame guide, a secondary air supply to enhance combustion and shape generally denominated 10 herein. These views illustrate the general structural and operative elements of an embodiment of the inventive apparatus. In its most essential aspect, the invention comprises a combination 12 that includes a gas burner 14, which in embodiments is an elongate cylindrical pipe 14, and an elongate plenum 16 disposed immediately above the gas burner through which secondary and tertiary air is supplied via air conduits 18 coupled to and in fluid communication with an air supply 20. For a conventional conveyor broiler of the kind used in commercial kitchens and restaurants, there are a plurality of burner/plenum combinations disposed laterally across the top of a cooking chamber 22 above a motorized chain conveyor 24 on which food product 26 is conveyed from a product inlet 28 to a product discharge or outlet 30.

In embodiments the spaced plenums 16 are each elongate cuboids with an inverted V-shaped heat reflector and air outlet plate 32 on the underside 34 of the plenum defining an inverted V-shaped trough 36 along which the burner pipe extends. The combined burners and plenums are laterally disposed in parallel rows above the belt conveyor.

As is well known, the cylindrical burner pipe typically includes a linear array of fuel/air outlets 40 along which the fuel/air mixture is distributed and output for combustion into an essentially type A flame F. However, and essentially, the heat reflector/air outlet plate 32 is an inverted V-shape that includes two linear arrays of air outlets straddling the upper portion of the burner through which plenum air is output into the vicinity of the burner output to produce two distinct effects.

In the first instance, first and second (i.e., a pair of) outboard linear arrays of air outlets 42*a*, 42*b*, one each disposed in an angled side of the inverted V-shaped heat reflector/air outlet plate 32, straddle the upper portion of the burner to provide a low pressure curtain of downwardly directed pressurized air that guides and directs heat from the flame downwardly toward the cooking food product 26. This air curtain and heat guide system is described in detail in U.S. Pat. No. 8,272,320 to Baker et al, which, as earlier noted, is incorporated in its entirety by reference herein.

In the next instance, first and second (i.e., also a pair of) inboard linear arrays of air outlets 44*a*, 44*b*, one each also disposed in an angled side of the inverted V-shaped heat reflector/air outlet plate 32, direct low pressure air from the plenum through the heat/reflector air outlet plate, down and into the flame, thereby providing excess air to complete combustion, increase efficiency, and further shape the flame to optimize it for use in a cuboid cooking chamber. Spacing and dimensions of the inboard linear arrays of air outlets are a function of burner size, air outlet size, air pressure, and the like, but the general purpose of the combination of outlet arrays is to enhance combustion, and to that end good results have been found having the inboard linear arrays 44*a*, 44*b*, generally straddle the burner equal distances above and on each side of the burner and at a distance apart from one another substantially the same as the burner diameter, as can be clearly seen in FIGS. 2A-2B.

Figure 4:
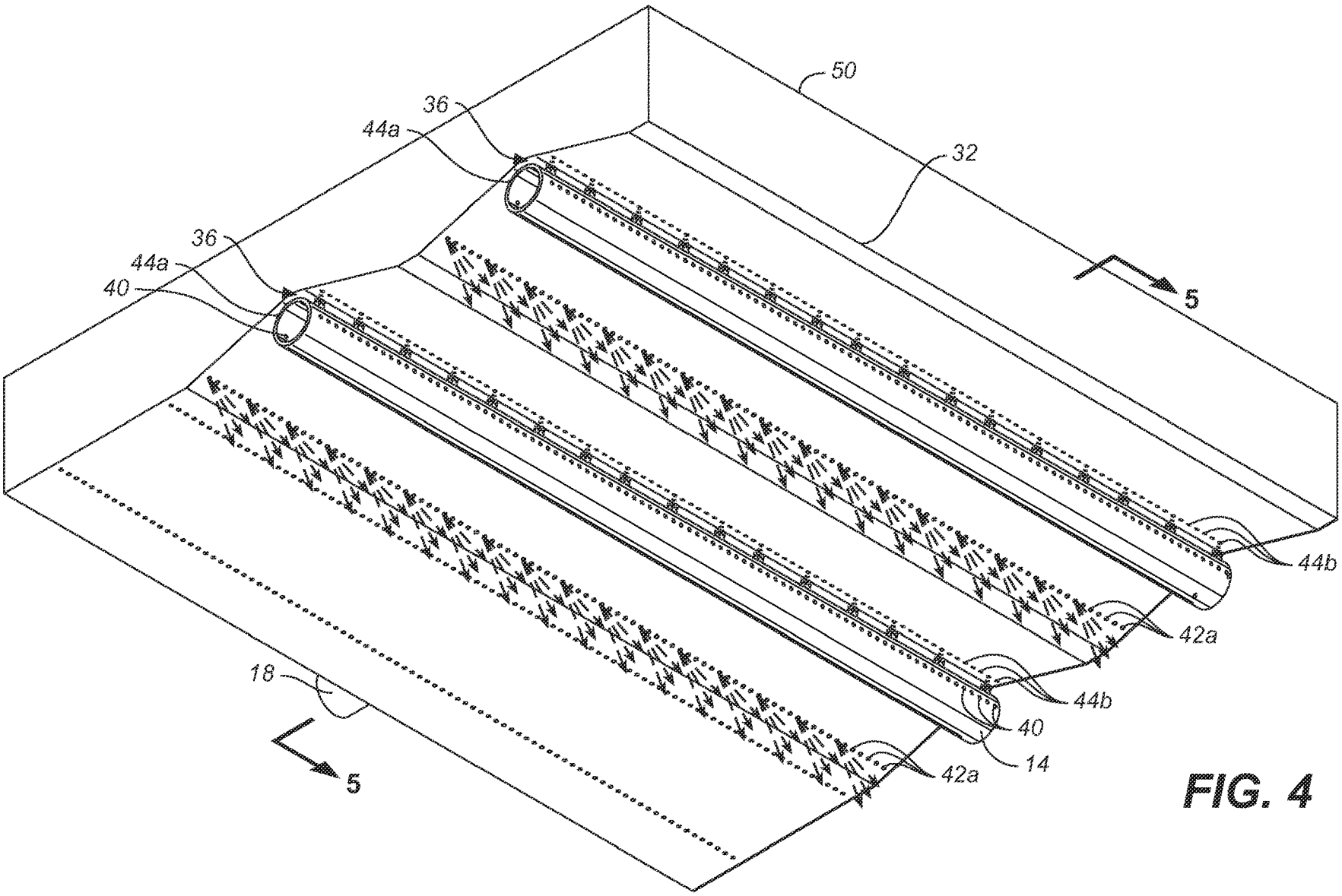
FIG. 4 is a lower perspective view of an alternative embodiment employing a unitary plenum (air box) and alternative air outlet configurations for the supply of secondary and tertiary air, the outlets configured to supply pressurized both to constrain and direct the burner flames and to enhance and substantially complete fuel combustion.
Figure 5:
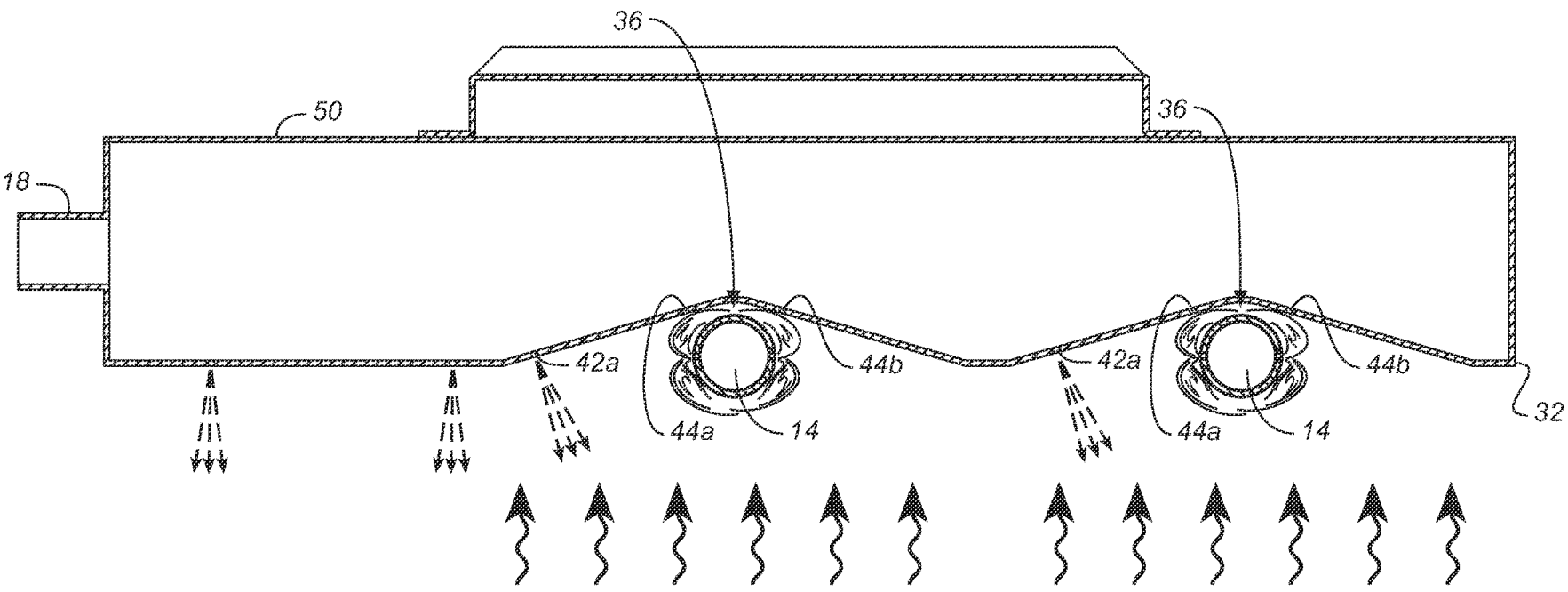
FIG. 5 is a cross-sectional side view in elevation thereof, as taken along section line 5-5 of FIG. 4.

In an alternative embodiment, and referring now to FIGS. 4-5, the plurality of plenums can be replaced by a unitary plenum 50 having a heat reflector/air outlet plate integral with the underside of the plenum. It includes an underside 32 configured with inverted V-shaped troughs 36 with essentially the same air hole patterns as those of the earlier described embodiment; provided, however, that this unitary embodiment may eliminate the second outboard array 42*b* of air holes used to provide the air curtain or guide. The need for the second outboard array may be obviated because a neighboring parallel outboard array 42*a* in the same plenum will suffice to provide the same complementary air curtain/guide when the burner elements and air outlet arrays are sufficiently close, the useful range of spacings being quite broad and easily identified through simple observation. In effect, this embodiment dispenses with the need to couple discrete plenums with an air supply pipe and to instead provide a single plenum to provide directed air over all or most burner elements in a cooking chamber. In all other respects, this embodiment is operationally identical to, and equally efficient as, the embodiment shown in FIGS. 1-3.

The technology of the present invention is incorporated in applicant's product models MV64 and FH94, which are dual belt, four lane gas flame conveyor broilers with automatic stack feeder for food product and the air supply system described above. Equipment testing of these models has shown exceptional and unexpected improvements in combustion efficiency, with corresponding reductions in broiler emissions and decreases in operating costs. Specifically, and as is considered more fully below, heavy-load cooking test data clearly show improved energy efficiency.

The public interest, as well as business interests in cost savings, ease of use, and pollution reduction, are benefitted by using the inventive system. Many energy utilities reward purchasers of energy efficient systems with rebates on purchase prices that match the energy savings. Equipment testing in a food service technology center was conducted on an implementation of the inventive system. In a dual belt conveyor broiler with four lanes, an automatic stack feeder, and the above-described burner configured with the gas, primary, secondary, and tertiary air supplies, data was collected to determine the energy input rate, preheat time and energy, idle energy rate, heavy-load cooking efficiency and production capacity using ASTM Standard Test Method F2239-10 (2021). In the case of the instant broiler, the savings (and the reduction in greenhouse gas emissions) is approximately 30%, and savings on commercial systems can therefore be substantial when both incentivizing rebates and the cost of energy consumption are considered. Indeed, the savings in the first year may represent a substantial portion of the entire purchase price of a system incorporating the inventive system. This is accomplished with no compromise (i.e., no increase) in cooking time.

A straightforward way to reduce the energy input in open broilers is to reduce the amount of fresh air that flows through the system, which also increases the overall heat to the unit. The liability in this approach is that it restricts a source of secondary air that needed for full and proper combustion from the burners: closing off the open front side makes the burners susceptible to incomplete combustion, and the flames become discontinuous across the burner surface. This problem is exacerbated when the broiler is under heavy cooking load because of the added effluent from the cooking food product, and this further starves the burner of oxygen.

By providing fresh air to the burners at the source of the flame, the inventive system may be closed to outside air while maintaining a stable burn, full combustion, and higher heat at comparable fuel consumption.

The above disclosure is sufficient to enable one of ordinary skill in the art to practice the invention and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed:

1. A gas burner and air supply system, comprising:

at least one elongate gas burner element configured for lateral placement across a gas broiler cooking chamber top, said gas burner in fluid communication with both a fuel supply and a primary air supply, and first and second generally linear arrays of fuel/air outlets disposed on opposing sides of said gas burner element through which combined fuel and air are output for combustion and to form a flame for cooking; and at least one air plenum in fluid communication with a pressurized air supply, said at least one air plenum having an underside with an inverted V-shaped trough disposed immediately above each gas burner in said system, and further including first and second pressurized inboard air outlet arrays, one each disposed above and along each side of said gas burner element, at a distance from the gas burner element corresponding to a flame region formed during combustion, to provide a secondary air supply to the combustion process in addition to said primary air to enhance gas combustion and shape the flame, wherein said pressurized air is introduced in a controlled manner into said flame region, to make it more efficient in a combustion chamber of the broiler cooking chamber, and at least one outboard array of pressurized air outlets disposed above and to an outboard side of each of said gas burners to create a tertiary air supply which in operation creates a downward curtain of pressurized air that guides and directs heat from the flames downwardly, wherein said secondary air supply and said tertiary air supply are functionally distinct such that the secondary air supply enhances combustion and the tertiary air supply guides heat.

2. The system of claim 1, wherein said first and second pressurized inboard air outlet arrays are substantially linear.

3. The system of claim 2, wherein said first and second pressurized inboard air outlet arrays are generally parallel to one another and on opposing sides of said gas burner element.

4. The system of claim 1, wherein said gas burner element is cylindrical and has a diameter.

5. The system of claim 4, wherein said first and second pressurized inboard air outlet arrays are spaced apart a distance substantially the same as the diameter of said gas burner element, such that said air outlet arrays are positioned relative to a flame region formed during combustion.

6. The system of claim 1, wherein said at least one outboard array of pressurized air outlets is generally linear.

7. The system of claim 1, wherein said at least one outboard array of pressurized air outlets is generally parallel to each of said inboard arrays of low pressure air outlets.

8. The system of claim 1, including a unitary plenum having a plurality of inverted V-shaped troughs, one each disposed over a gas burner element.

9. The system of claim 1, including a plurality of plenums, each of said plenums having first and second outboard arrays of pressurized air outlets.

10. The system of claim 1, wherein said secondary air supply may be controlled to match the air needed to completely burn the fuel output from said gas burner element, thereby enhancing combustion efficiency.

11. The system of claim 1, wherein said first and second pressurized inboard air outlet arrays are spaced apart from said gas burner element at a distance proportional to the diameter of said gas burner element, such that said air outlet arrays are positioned within a flame region during operation.

12. The system of claim 11, wherein said first and second pressurized inboard air outlet arrays are spaced apart from said gas burner element at a distance proportional to the pressure under which fuel is expelled from said gas burner element, such that air is introduced into said flame region to enhance combustion.

13. A gas burner and air supply system, comprising:

at least one elongate gas burner element configured for lateral placement across a gas broiler cooking chamber top, said gas burner in fluid communication with both a fuel supply and a primary air supply, and first and second generally linear arrays of fuel/air outlets disposed on opposing sides of said gas burner element through which combined fuel and air are output for combustion and to form a flame for cooking; and at least one air plenum in fluid communication with a pressurized air supply, said at least one air plenum having an underside with an inverted V-shaped trough disposed immediately above each gas burner in said system, and further including first and second pressurized inboard air outlet arrays, one each disposed above and along each side of said gas burner element, at a distance from the gas burner element corresponding to a flame region formed during combustion, to provide a secondary air supply to the combustion process in addition to said primary air to enhance gas combustion and shape the flame, wherein said pressurized air is introduced in a controlled manner into said flame region, to make it more efficient in a combustion chamber of the broiler cooking chamber, and at least one outboard array of pressurized air outlets disposed above and to an outboard side of each of said gas burners to create a tertiary air supply which in operation creates a downward curtain of pressurized air that guides and directs heat from the flames downwardly, wherein said secondary air supply and said tertiary air supply are functionally distinct such that the secondary air supply enhances combustion and the tertiary air supply guides heat;

wherein said first and second pressurized inboard air outlet arrays are substantially linear;

wherein said first and second pressurized inboard air outlet arrays are generally parallel to one another and on opposing sides of said gas burner element;

wherein said gas burner element is cylindrical and has a diameter;

wherein said first and second pressurized inboard air outlet arrays are spaced apart a distance substantially the same as the diameter of said gas burner element, such that said air outlet arrays are positioned relative to a flame region formed during combustion;

wherein said first and second pressurized inboard air outlet arrays are spaced apart from said gas burner element at a distance proportional to the diameter of said gas burner element, such that said air outlet arrays are positioned within a flame region during operation; and wherein said first and second pressurized inboard air outlet arrays are spaced apart from said gas burner element at a distance proportional to the pressure under which fuel is expelled from said gas burner element, such that air is introduced into said flame region to enhance combustion.

* * * * *